US006531428B2

(12) United States Patent
Nakazato et al.

(10) Patent No.: US 6,531,428 B2
(45) Date of Patent: Mar. 11, 2003

(54) LOW PHOSPHOROUS ENGINE OIL COMPOSITION AND ADDITIVE COMPOSITIONS

(75) Inventors: Morikuni Nakazato, Ogasa-gun (JP); Jiro Magarifuchi, Ogasa-gun (JP); Akihiro Mochizuki, Tokyo (JP); Hiroshi Tanabe, Matsudo (JP)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/222,495

(22) Filed: Apr. 4, 1994

(65) Prior Publication Data

US 2002/0098990 A1 Jul. 25, 2002

Related U.S. Application Data

(63) Continuation of application No. 07/927,906, filed on Aug. 10, 1992, now abandoned.

(30) Foreign Application Priority Data

Aug. 9, 1991 (JP) ..... 3-223664

(51) Int. Cl.[7] ..... C10M 141/12; C10M 141/06; C10M 141/00

(52) U.S. Cl. ..... 508/192; 508/373; 508/375; 508/376; 508/378

(58) Field of Search ..... 252/47, 32.7 E, 252/47.5; 508/376, 378, 373, 375, 192

(56) References Cited

U.S. PATENT DOCUMENTS

| | | | | | |
|---|---|---|---|---|---|
| 3,876,550 | A | | 4/1975 | Holubec | 252/47.5 |
| 3,923,669 | A | | 12/1975 | Newingham et al. | 252/32.7 |
| 4,125,479 | A | | 11/1978 | Chesluk et al. | 252/33.6 |
| 4,207,196 | A | | 6/1980 | Sudekum | 252/47.5 |
| 4,383,931 | A | * | 5/1983 | Ryu et al. | 252/47 |
| 4,501,678 | A | | 2/1985 | Katayama et al. | 252/32.7 |
| 4,609,480 | A | * | 9/1986 | Hata et al. | 252/47 |
| 4,648,985 | A | | 3/1987 | Thorsell et al. | 252/32.5 |
| 4,836,942 | A | * | 6/1989 | Lam | 252/47 |
| 4,859,352 | A | | 8/1989 | Waynick | 252/41 |
| 4,879,054 | A | | 11/1989 | Waynick | 252/41 |
| 4,880,551 | A | | 11/1989 | Doe | 252/47.5 |
| 4,959,166 | A | * | 9/1990 | Minamitani et al. | 252/47 |
| 5,019,284 | A | * | 5/1991 | Farng et al. | 252/46.7 |
| 5,158,694 | A | * | 10/1992 | Waynick | 252/50 |

FOREIGN PATENT DOCUMENTS

| | | |
|---|---|---|
| EP | 024146 | 2/1981 |
| EP | 0234923 | 2/1987 |
| WO | 86/4601 | 8/1986 |
| WO | 89/4358 | 5/1989 |

OTHER PUBLICATIONS

Patent Abstracts of Japan vol. 003, No. 133 (C–063) Nov. 7, 1979 for JP–A–54 113,604 pub. Sep. 1979.

W. M. Denton and S. A. M. Thompson, "Screening of Compounds for Anti–Oxidant Activity in Motor Oil," *Inst. Petrol. Review* 20 (230), pp. 46–54 (1966).

M. Born et al., "Relationship between Chemical Structure and Effectiveness of Some Dialkyl–Diaryldithiophosphates in Lubricated Mech.", *Lubrication Science*, 4–2, pp. 97–100.

M. and I. Ash, *Handbook of Industrial Chemical Additives* (1991) pp. 573–574.

M. and I. Ash, *Encyclopedia of Industrial Chemical Additives*, vol. I, (1984) pp. 88–89 and pp. 469–471.

* cited by examiner

*Primary Examiner*—Margaret Medley
(74) *Attorney, Agent, or Firm*—Steven G. K. Lee

(57) ABSTRACT

A low phosphorous lubricating oil composition for internal combustion engines comprising an alkylthiocarbamate compound of the formula:

(I)

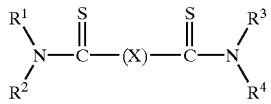

wherein each of $R^1$, $R^2$, $R^3$, and $R^4$ independently represents an alkyl group of 1–18 carbon atoms, and (X) represents S, S—S, S—$CH_2$—S, S—$CH_2CH_2$—S, S—$CH_2CH_2CH_2$—S, or S—$CH_2CH(CH_3)$—S, and additive compositions and additive packages utilizing the above compound.

8 Claims, No Drawings

LOW PHOSPHOROUS ENGINE OIL COMPOSITION AND ADDITIVE COMPOSITIONS

This is a continuation of application Ser. No. 07/927,906, filed Aug. 10, 1992 now abandoned.

BACKGROUND OF THE INVENTION

This invention relates to improved lubricating oils, especially internal combustion engine lubricating oils, and additives and additives mixtures employable for the preparation of such lubricating oils.

Automobile spark ignition and diesel engines have valve train systems, including valves, cams and rocker arms which present special lubrication concerns. It is extremely important that the lubricant, i.e. the engine oil, protects these parts from wear. Further, it is important for engine oils to suppress the production of deposits in the engines. Such deposits are produced from non-combustibles and incomplete combustibles of hydrocarbon fuels (e.g., gasoline, diesel fuel oil) and by the deterioration of the engine oil employed.

Engine oils use a mineral oil or a synthetic oil as a base oil. However, simple base oils alone do not provide the necessary properties to provide the necessary wear protection, deposit control, etc. required to protect internal combustion engines. Thus, base oils are formulated with various additives, for imparting auxiliary functions, such as ashless dispersants, metallic detergents (i.e., metal-containing detergents), antiwear agents, antioxidants (i.e., oxidation inhibitors), viscosity index improvers and the like to give a compounded oil (i.e., a lubricating oil composition).

A number of such engine oil additives are known and employed in practice. Zinc dialkyldithiophosphates are, for example, because of their favorable characteristics as an antiwear agent and performance as an oxidation inhibitor, contained in most all of the commercially available internal composition engine oils, especially those used for automobiles.

However, a problem has arisen with respect to the use of zinc dialkyldithiophosphate, because phosphorous derivatives poison catalyst components of catalytic converters. This is a major concern, because effective catalytic converters are needed to reduce pollution and to meet governmental regulation designed to reduce toxic gases, such as hydrocarbons, carbon monoxide, and nitrogen oxides, in internal combustion engine exhaust emission. Such catalytic converters generally use a combination of catalytic metals, such as platinum or variations, and metal oxides and are installed in the exhaust streams, e.g., the exhaust pipes of automobiles, to convert the toxic gases to nontoxic gases. As before mentioned these catalyst components are poisoned by the phosphorous component, or the phosphorous decomposition products of the zinc dialkyldithiophosphate; and accordingly, the use of engine oils containing phosphorous additives may substantially reduce the life and effectiveness of catalytic converters. Therefore, it would be desirable to reduce the phosphorous content in the engine oils so as to maintain the activity and extend the life of the catalytic converter.

There is also governmental and automotive industry pressure towards reducing phosphorous content; for example, United States Military Standards MIL-L-46152E and the ILSAC Standards defined by the Japanese and United States Automobile Industry Association require engine oils to have phosphorous content below 0.12 wt. %. The phosphorous content in most high grade engine oils containing zinc dialkyldithiophosphate is approximately 0.1 wt. %, and thus meet the 0.12 wt % requirement. Nevertheless, it would be desirable to decrease the amount of zinc dialkyldithiophosphate in lubricating oils still further, thus reducing catalyst deactivation and hence increasing the life and effectiveness of catalytic converters. However, simply decreasing the amount of zinc dialkyldithiophosphate presents problems because this necessarily lowers the antiwear properties and oxidation inhibition properties of the lubricating oil. Therefore, it is necessary to find a way to reduce phosphorous content while still retaining the antiwear and oxidation or corrosion inhibiting properties of the higher phosphorous content engine oils.

In order to compensate for lowering the amount of zinc dialkyldithiosphate, the use of other oxidation inhibitors such as phenol derivatives and amine derivatives have been studied. However, the use of such known oxidation inhibitors in place of zinc dialkyldithiophosphate at best only marginally satisfies the required levels of antiwear and oxidation inhibition. The use of magnesium sulfonate detergents which are also effective to enhance the antiwear properties in valve train systems has also been studied and, in fact, some commercially available engine oils use a magnesium sulfonate detergent. However, engine oils containing a magnesium sulfonate detergent have drawbacks in that crystalline precipitates are sometimes produced when these engine oils are stored under humid or variable temperature conditions for a long period of time. Such precipitates may cause plugging of the filter which is installed in the engine oil circulating system. Such plugging is more likely to occur when a large amount of the magnesium sulfonate detergent is used so as to enhance the desired antiwear properties. Thus, the use of magnesium sulfonate detergents is not a satisfactory solution.

At the present time, demand for further decrease of phosphorous content is very high from the viewpoint of the aforementioned problems. For instance, it is sometimes desired to decrease the phosphorous content to levels below the regulated upper limit and the 0.1 wt. % phosphorous level of today's better engine oil. This reduction cannot be satisfied by the present measures in practice and still meet the severe antiwear and corrosion inhibiting properties required of today's engine oils.

Thus, it would be desirable to develop lubricating oils, and additives and additive packages therefore, having low levels of phosphorous but which still provide the needed wear protection and corrosion protection now provided by lubricating oils having higher levels of zinc dialkyldithiophosphate, but which do not suffer from the disadvantages of the low phosphorous level lubricants discussed above.

U.S. Pat. No. 3,876,550 (issued 1975) discloses lubricating compositions containing an alkylene bis (dithiocarbamate), as an antioxidant, and a substituted succinic acid as a rust inhibitor. The alkylene dithiocarbamate is represented in the patent by the formula $R^1R^2N—C(S)—S\text{-alkylene-}S—C(S)—NR^3R^4$. Example 5 of the patent describes a crankcase lubricant containing a VI improver, an ashless dispersant and methylene bis (dibutyldithiocarbamate). The patent further teaches that the composition may also contain various other additives, for example, detergents, dispersants, VI improvers, extreme pressure agents, antiwear additives, etc., as well as other oxidation inhibitors and corrosion inhibitors (Col. 7, lines 35–55) and cites an extensive list of extreme pressure agents, corrosion inhibitors and antioxidants, including zinc salts of phosphorodithoic acid (Col. 8, lines 1–22).

The use of methylene bis(dibutyldithiocarbamate) as an oxidation inhibitor in lubricating oils, in combination with other ingredients, is also disclosed in U.S. Pat. Nos. 4,125,479 (1978) and 4,880,551 (1989).

U.S. Pat. No. 4,879,054 (1989) is directed to cold temperature greases and teaches using dithiocarbamates such as Vanlube 7723, i.e., 4,4'-methylene bis(dithiocarbamate), in such greases to provide extreme pressure antiwear properties (Col. 6, lines 18–28). Examples 13–18 (Col. 14, lines 26–32) describe using Vanlube 7723 and triarylphosphate as replacements for lead naphthenate and zinc dithiophosphate. The use of dithiocarbamates as extreme pressure antiwear additives is also taught by U.S. Pat. No. 4,859,352, and U.S. Pat. No. 4,648,985 teaches that the combination of dithiocarbamates with zinc dithiophosphate and copper salts of carboxylic acid provide lubricants with extreme pressure properties.

SUMMARY OF THE INVENTION

The present invention provides lubricating oil compositions which provide high antiwear protection and oxidation-corrosion protection, but which have only low levels of phosphorous, less than 0.1 wt. % and preferably not more than 0.08 wt %. Thus, the present lubricating compositions are much more environmentally desirable than the higher phosphorous lubricating compositions generally used in internal combustion engines because they facilitate longer catalytic converter life and activity and yet provide the desired high wear protection and corrosion inhibition.

The present lubricating composition comprises a base oil of lubricating viscosity and a wear inhibiting, corrosion inhibiting effective amount of a thiocarbamate compound, or mixture of compounds, having the formula:

(I)

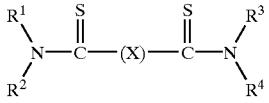

wherein each of $R^1$, $R^2$, $R^3$ and $R^4$, independent of each other, represents an alkyl group of 1–18 carbon atoms, and (X) represents S, S—S, S—$CH_2$—S, S—$CH_2CH_2$—S, S—$CH_2CH_2CH_2$—S, or S—$CH_2CH(CH_3)$—S, and an amount of zinc dialkyldithiophosphate which provides a phosphorous content, based on the total weight of the lubricating composition, less than 0.1 and preferably not exceeding 0.08 wt. %, and more preferably not exceeding 0.06 wt. %.

In another aspect the invention provides an additive package composition or concentrate comprising one or more compounds of formula (I) in an organic diluent liquid, for example, base oil and preferably containing various other additives desired in lubricating oil compositions such as, for example, metal-containing detergents and ashless dispersants.

FURTHER DESCRIPTION OF THE INVENTION AND EMBODIMENTS

It has been found that the incorporation of the compound of formula (I) or mixtures thereof into synthetic or mineral base oils provides lubricating oils which provide excellent wear protection and corrosion inhibition in internal combustion engines, especially if incorporated with low levels of zinc dialkyldithiophosphates. The compounds of formula (I) (hereafter referred to as thiocarbamates) i.e.

(I)

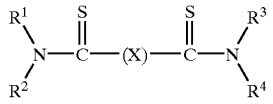

wherein $R^1$, $R^2$, $R^3$ and $R^4$ and (X) are as defined herein-above, are known compounds and can be prepared by known procedures, and in some cases have been employed as vulcanizing accelerators and as additives for gear oils and turbine oils and hence readily commercially available. Referring to the $R^1$, $R^2$, $R^3$ and $R^4$ groups, the alkyl group may be linear (straight chain) or branched chain and preferably have 1 through 10 carbon atoms, more preferably 1 through 6 carbon atoms. Typical alkyl groups include, for example, methyl, ethyl, propyl, n-butyl, isobutyl, pentyl, isopentyl, heptyl, octyl, 2-ethylhexyl, nonyl, decyl, and dodecyl. Typical examples of the thiocarbamate compounds of the formula (I) are methylene bis(dibutyldithiocarbamate), bis(dimethylthiocarbamoyl) monosulfide, bis(dimethylthiocarbamoyl) disulfide, bis(dibutylthiocarbamoyl) disulfide, bis(diamyltiocarbamoyl) disulfide, and bis(dioctylthiocarbamoyl)disulfide. These compounds can be used singly or in combination of two or more compounds in combination with low levels of zinc dialkyldithiophosphates and afford good wear and corrosion protection and also have good oil solubility. The thiocarbamate compound is generally incorporated into base oils to give a compounded engine oil containing 0.05–8 wt. %, preferably 0.1–4 wt. % more preferably 0.5–2 wt. % of the thiocarbamate compound. In general, by increasing the amount of zinc dialkyldithiophosphate, lower amounts of thiocarbamate, within the above described ranges, can be use.

We have found that excellent results are obtained in terms of both engine protection and environmental low phosphorous consideration by using the thiocarbamate in combination with very low levels of zinc dialkyldithiophosphate. It is advantageous to use the thiocarbamate and zinc dialkyldithiophosphate in combination at appropriate ratios such that the phosphorous content of the compounded engine oil is less than 0.1 wt. %, preferably no higher than 0.08 wt. %, and more preferably not higher than 0.06 wt. %, and yet provides the desired levels of antiwear properties and oxidation inhibition. On the other hand, in order to ensure the high wear protection and corrosion inhibition required by both today's and future engines, we have found that the amount of zinc dialkyldithiophosphate expressed in terms of phosphorous content should provide a phosphorous content of about from 0.03 to 0.09 wt. %, preferably 0.04 to 0.08 wt. % based on the total weight of the lubricating oil composition. We have discovered that the weight ratio of the thiocarbamate compound to the zinc dialkyldithiophosphate should preferably be in the range of 1:0.1 to 1:20 and more preferably in the range of from 1:0.2 to 1:10. Best results, in terms of the aforementioned considerations, are obtained when the lubricating composition has a phosphorous content, furnished by the zinc dialkyldithiophosphate, of from 0.05 to 0.07 wt. % and the weight ratio of the thiocarbamate compound of formula (I) to the zinc dialkyldithiophosphate is in the range of about from 1:0.2 to 1:10. (It should perhaps be noted that because of the phosphorus catalyst poisoning problem, that with the exception of zinc dialkyldithiophosphate, that phosphorus containing compounds are avoided in such engine oils, particularly those intended for use in automotive engines. Thus, in the case of the present invention, phosphorus content is calculated based on the zinc dialkyldithiophosphate and its molecular phosphorus content, and directly equates to zinc dialkyldithiophosphate content.)

Zinc dialkyldithiophosphates are, of course, known wear inhibiting agents and can be obtained from commercial sources or, if desired, prepared by known procedures. As is well known, zinc dialkyldithiophosphates refer to a class of compounds generally having the formula

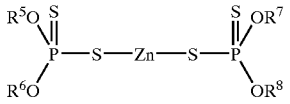

wherein $R^5$, $R^6$, $R^7$ and $R^8$ are independently alkyl or alkylphenyl.

Typically the alkyl group has about from 1 to 20 carbon atoms, preferably 3 to 10 carbon atoms, and can be straight chained or branched. In the present invention we have found that very good results are obtained using zinc dialkyldithiophosphates wherein the R groups are branched alkyl having about 3 to 6 carbon atoms. A variety of zinc dialkyldithiophosphates are, for example, described in an article by M. Born et al. entitled "Relationship between Chemical Structure and Effectiveness of Some Metallic Dialkyl- and Diaryl-dithiophosphates in different Lubricated Mechanisms", appearing in Lubrication Science 4-2 January 1992, see for example pages 97–100. The base oil may be a mineral oil or synthetic oil or a blend of mineral oils and/or synthetic oils blended to give a base oil of the desired internal combustion engine oil viscosity. Typically, individually the oils used as its base oil will have a viscosity range of about from 10 to 120 cST at 40° C. and will be selected or blended depending on the desired end use and the additives in the finished oil to give the desired grade of engine oil.

Preferably, as well as the thiocarbamate compound and zinc dialkyldithiophosphate and base oil, the lubricating oil composition will also contain various additives for imparting auxiliary functions, for example, metal-containing detergents, ashless dispersants, viscosity index improvers and the like, to give a finished lubricating oil in which these additives are dissolved or dispersed. A variety of metal-containing detergents, ashless dispersants, and viscosity index improvers are known and commercially available. These additives, or their analogous compounds, can be employed for the preparation of the engine oils of the invention by the usual blending procedures.

As the metal-containing detergent, a metal phenate or a metal sulfonate is generally employed. Preferably, the metal phenate is an alkaline earth metal salt of sulfide of alkylphenol having an alkyl group of approximately 8–30 carbon atoms. Generally employed alkaline earth metals are calcium, magnesium and barium. Preferably the metal sulfonate is an alkaline earth metal salt of a sulfonated aromatic compound or a sulfonated mineral oil having a molecular weight of approximately 400–600. Generally employed alkaline earth metals are also calcium, magnesium and barium. The metal phenate and metal sulfonate can be used singly or in combination. Also employed are other metal-containing detergents such as salicylates, phosphorates and naphthenates of alkaline earth metals. These detergents can be employed singly or in combination. The aforementioned phenate and sulfonate can be employed in combination with these other metal-containing detergents. The metal-containing detergents can be of a neutral type or of an over-based better type having an alkalinity value of 150 to 300 or more. The metal-containing detergent is generally incorporated into an engine oil in an amount of 0.5–20 wt. % based on total weight of the engine oil (i.e., compounded oil). Although magnesium salts of phenate and sulfonate may, in some cases, enhance antiwear properties, they, as noted above, have a storage stability problem. In consideration of this problem, it is generally preferred to use calcium salts (e.g., phenates, sulfonates, etc.) in combination with the thiocarbamate compounds used in the present invention.

Examples of the ashless dispersants which may be used in the present engine oil are alkyl or alkenyl substituted succinimides, succinic esters and benzylamines, in which the alkyl or alkenyl group has a molecular weight of approximately 700–3,000. The derivatives of these dispersants, e.g., borated dispersants, may also be used. The ashless dispersant is generally incorporated into an engine oil in an amount of 0.5–15 wt. % per total amount of the engine oil.

Examples of the viscosity index improvers are poly-(alkyl methacrylate), ethylene-propylene copolymer, polyisoprene, and styrene-butadiene copolymer. Viscosity index improvers of dispersant type (having increased dispersancy) or multifunctional type are also employed. These viscosity index improvers can be used singly or in combination. The amount of viscosity index improver to be incorporated into the engine oil varies with viscosity requirements of the engine oil, but generally in the range of about 0.5 to 20% by weight of the total weight of the engine oil lubricating composition.

As well as the above additives, the lubricating oil composition may contain various other additives such as, for example, extreme pressure agents, corrosion inhibitors, rust inhibitors, friction modifiers, anti-foaming agents, and pour point depressants. Other oxidation inhibitors such as hindered phenols and other antiwear agents can be used in combination with the thiocarbamate compound of formula (I).

In another embodiment of the invention, the thiocarbamate of formula (I) and zinc dialkyldithiophosphate may be provided as an additive package or concentrate which will be incorporated into a base oil at a different site or time. The package will contain the two aforementioned components in the weight ratio previously specified for incorporation into the base oil and generally will also contain a compatible diluent or carrier liquid, e.g., base oil. Typically a neutral oil having a viscosity of about 4–8.5 cST at 100° C. preferably 4–6 cST at 100° C. will be used as the diluent, though synthetic oils, as well as other organic liquids which are compatible with the additives and finished lubricating oil can also be used. The additive package will also typically contain one or more of the various other additives, referred to above, in the desired amounts and ratios to facilitate direct combination with the requisite amount of base oil.

Preferably, the additive concentrate comprises a metal-containing detergent, an ashless dispersant and an alkylthiocarbamate compound of the formula (I), zinc dialkyldithiophosphate and optional components dissolved or dispersed in an organic liquid diluent, at a high concentration. The additive concentrate is preferably prepared by mixing 100 weight parts of a metal-containing detergent, 10–700 weight parts of an ashless dispersant, and 2–200 weight parts of the thiocarbamate compound of the formula (I) plus a proportional amount of zinc dialkyldithiophosphate. In some cases it may be desirable to omit the viscosity index improver, depending on the particular type, because of compatibility problems which may occur at the high additive concentration used in the additive package.

A further understanding of the invention can be had from the following non-limiting examples.

EXAMPLES

At present, the performances of engine oils are evaluated by various bench scale tests and engine tests. Typical standard engine tests are conducted according to requirements of API service classifications. The maximum class for engine oils of motor cars for service stations is named API-SG. In order to pass the requirements defined in API-SG, evaluations using engines fixed on beds, which are named SEQ (sequence) IID, SEQ IIIE, SEQ VE, CAT $1H_2$ and CRC L-38 are generally conducted. In some instances a CAT $1H_2$ (fixed bed test for evaluating diesel oils) is also conducted.

The commercially available engine oils classified into API-SG oil contain zinc dialkyldithiophosphate in an amount corresponding to the phosphorous content of approximately 0.1 wt. %. It has been observed that if the amount of zinc dialkydithiophosphate is reduced so as to decrease the phosphorous content, the resulting engine oils show poor results in the evaluation of wear of valve train systems defined in the SEQ IIIE test and the SEQ VE test, and also give poor results in the observation of viscosity increase defined in the SEQ IIIE test. This means that such engine oil fails to pass the level defined for the API-SG class.

Example 1

The most severe of the above mentioned tests is the SEQ VE test and, accordingly, all of the formulated oils in this example were tested using the SEQ VE test. In addition, the commercial standard, comparative Formula No. 1 and Formulation 5 of the present invention were also tested by the SEQ IIIE test and CAT $1H_2$ test.

The SEQ IIIE test is performed in a 3.6 liter, V-6 engine of General Motors which is operated at 149° C. (oil temperature) for 64 hours using lead-containing gasoline. This test is conducted for examining oxidation stability of engine oils at an elevated temperature and property of preventing wear of valve train systems. This test measures viscosity increase (%), oil ring land deposit, piston skirt varnish, average sludge, cam plus lifter wear (average) and cam plus lifter wear (maximum).

The CAT $1H_2$ test is performed in 2.2 liter monocylinder diesel engine of Caterpillar Inc. which is operated for 480 hours using gas oil containing 0.4% of sulfur. This test is conducted for examining detergency at an elevated temperature. This test measures TGF (top groove carbon fill), WTD (weighted total demerit), each for 240 hours operation and 480 hours operation.

The SEQ VE test is performed in a 2.3 liter engine of Ford Motor Co. (L-4, OHC) using lead-free gasoline, which is operated cyclicly for 288 hours. This test is made for examining detergency for engines such as a tendency to produce sludge in the operations at low and middle temperatures as well as examining wear of the valve train system. If the wear of the valve train system is high, a large amount of iron in the form of microparticles which are produced through the wear of the valve train system are dispersed in the engine oil employed so as to accelerate production of sludge. This test measures engine sludge, rocker cover sludge, engine varnish, piston skirt varnish, cam wear (average) and cam wear (maximum).

The engine oil formulations and the results of the testing are set forth in Table 1. Also presented in Table 1 are the pass limits for the respective engine tests in the form of grading points (in terms of merit) or measured value.

Details of the additives used are described below. The base oil was a paraffinic mineral oil having a viscosity index value (VI value) of 100. The engine oil was formulated to give viscosity conditions of SAE 10W30 defined in the API Service Classification. Supplemental additives such as anti-foaming agents were added if required.

Additives:

Metallic detergent—Metal-containing detergent (mixture of overbased calcium sulfonate and neutral calcium sulfonate).

Ashless dispersant—Boric acid-modified succinimide (for the formulated engine oil No. 2 only, polyisobutenyl succinic ester of 1 wt. % was added).

Thiocarbamate—Methylene bis(dibutyldithiocarbamate) of the invention.

ZnDTP—Zinc dialkyldithiophosphate of secondary alkyl type (alkyl carbon atom number: 3 to 6).

Oxidation inhibitor—Organic oxidation inhibitor (mixture of hindered phenol and dialkyldiphenylamine).

EP agent—Extreme pressure agent of sulfur type (diparaffin sulfide).

VI improver—Viscosity index improver (dispersant type ethylene-propylene copolymer).

Pour point depressant—of polymethacrylate type.

TABLE 1

| Engine Oil Tested | | API-SG Commercial Products | Formulated Engine Oils No. 1 | No. 2 | No. 3 | No. 4 | No. 5 | No. 6 |
|---|---|---|---|---|---|---|---|---|
| (Formulations) | | | | | | | | |
| Viscosity Grade | | SAE 10W30 | | | | | | |
| Phosphorous Content (wt. %) | | 0.1 | 0.056 | | | | | |
| Additives (wt. %) | | | | | | | | |
| Metallic detergent | | 2.5 | 2.5 | 2.5 | 2.5 | 2.5 | 2.5 | 2.5 |
| Ashless dispersant | | 5.8 | 5.8 | 6.8 | 5.8 | 5.8 | 5.8 | 5.8 |
| Thiocarbamate | | — | — | — | — | 1.0 | 0.7 | 0.3 |
| ZnDTP | | 1.3 | 0.7 | 0.7 | 0.7 | 0.7 | 0.7 | 0.7 |
| Oxidation inhibitor | | 1.0 | 1.3 | 1.3 | 1.6 | 1.3 | 0.7 | 0.7 |
| EP agent | | — | — | — | 1.0 | 0.3 | — | — |
| VI improver | | 6.3 | 6.3 | 6.3 | 6.3 | 6.3 | 6.3 | 6.3 |
| Pour point depressant | | 0.4 | 0.4 | 0.4 | 0.4 | 0.4 | 0.4 | 0.4 |
| (Test Results) | | | | | | | | |
| SEQ VE (Pass limit) | | | | | | | | |
| Sludge Average | (≧9.0) | 9.4 | 6.9 | 6.8 | 7.2 | 9.0 | 9.2 | 7.4 |
| Rocker Cover | (≧7.0) | 8.9 | 5.6 | 5.5 | 4.4 | 8.0 | 8.1 | 6.6 |
| Varnish Average | (≧5.0) | 6.4 | 6.3 | 5.5 | 7.5 | 6.8 | 6.6 | 6.5 |
| Piston Skirt | (≧6.5) | 7.1 | 7.4 | 7.3 | 7.2 | 6.8 | 7.5 | 6.5 |

TABLE 1-continued

| Engine Oil Tested | | API-SG Commercial Products | Formulated Engine Oils No. 1 | No. 2 | No. 3 | No. 4 | No. 5 | No. 6 |
|---|---|---|---|---|---|---|---|---|
| Cam Wear | (≦5) | 1 | 14 | 16 | 11 | 5 | 1 | 10 |
| Average | | | | | | | | |
| Maximum | (≦15) | 1 | 20 | 20 | 16 | 11 | 1 | 14 |
| SEQ IIIE (Pass limit) | | | | | | | | |
| Viscosity Increase | (≦375) | 330 | 542 | — | — | — | 223 | |
| Land Deposit | (≧3.5) | 4.4 | 6.0 | — | — | — | 6.8 | |
| Varnish | (≧8.9) | 9.0 | 9.0 | — | — | — | 9.0 | |
| Average Sludge | (≧9.2) | 9.5 | 9.4 | — | — | — | 9.5 | |
| Cam Lifter Wear | | | | | | | | |
| Average | (≦30) | 13 | 21 | — | — | — | 7 | |
| Maximum | (≦64) | 16 | 27 | — | — | — | 17 | |
| CAT $1H_2$ (Pass limit) | | | | | | | | |
| 240 hours | | | | | | | | |
| TGF | | 2 | 2 | — | — | — | 9 | |
| WTD | | 81 | 91 | — | — | — | 51 | |
| 480 hours | | | | | | | | |
| TGF | (≦45) | 8 | 3 | — | — | — | 16 | |
| WTD | (≦140) | 151 | 182 | — | — | — | 140 | |

As can be seen from Table 1 seven formulated engine oils were tested i.e., one a commercial engine oil meeting API-SG requirements but having a phosphorous content of 0.1 wt. % due to 1.3 wt. % zinc dialkyldithiophosphate and six test formulations in which the zinc dialkyldithiophosphate content was reduced to 0.7 wt. % thus reducing the phosphorous content to 0.056 wt. %. Formulation Nos. 4 and 5 represent compositions according to the present invention. Formulation Nos. 1–3 represent comparative formulations which do not contain a compound of formula (I). Formulation No. 6 represents a formulation containing the same thiocarbamate as Formulation Nos. 4 and 5, but in a substantially reduced amount. The only formulations which passed all of the tests of the SEQ VE were the commercial lubricating oil having a phosphorous content of 0.1 wt. % and Formulation Nos. 4 and 5 of the present invention. Formulation No. 3 was identical to Formulation No. 4 with the exception that Formulation No. 4 contained 1 wt. % of the thiocarbamate in accordance with the present invention, whereas Formulation No. 3 had higher levels of an oxidation inhibitor and an extreme pressure agent (1 wt. % versus 0.3 wt. % for Formulation No. 4), yet Formulation No. 3 failed four of the six tests. Formulation No. 5 was identical to Comparative Formulation Nos. 1 and 2 with the exception that Formulation No. 5 contained 0.7 wt. % of the thiocarbamate, in accordance with the present invention, whereas Formulation Nos. 1 and 2 contained higher levels of the oxidation inhibitor and Formulation No. 2 also contained more ashless dispersant. Again, Formulation Nos. 1 and 2 failed four of the six tests whereas Formulation No. 5 passed each test. Formulation No. 6 did not contain sufficient thiocarbamate to provide the desired wear and corrosion protection because of the very low amount of zinc dialkyldithiophosphate (i.e., measured as phosphorus 0.056 wt. %).

Based on the test data set forth in Table 1, engine oil No. 4 and No. 5 of the present invention satisfy the SEQ VE requirements of API-SG (top grade for commercially available engine oils), even though the phosphorous contents of these engine oils are extremely low i.e., 0.056 wt. %. In contrast, the engine oils No. 1, No. 2 and No. 3 containing no thiocarbamate compound could not pass the pass limits set for the API-SG classification. Particularly, the latter engine oils showed apparently poorer performances in cam wear and prevention of sludge, as compared with the commercially available API-SG engine oil and the engine oil according to the present invention. The engine oils of the invention showed excellent performances in the anti-wear and oxidation inhibition characteristics even at a phosphorous content reduced to about half of the generally adopted content. The observed performances were almost the same as those of a representative commercially available top-grade engine oil.

Example 2

In this example a higher phosphorous level engine oil, according to the invention, but containing only 0.2 wt. % of the same thiocarbamate used in Example 1, was tested using the SEQ VE test described in Example 1. A comparison formulation was also tested. The two formulations were both 0.09 wt. % phosphorous, provided by zinc dialkyldithiophosphate, SAE 5W30 oils and were identical except that Formulation 7 contained 0.2 wt. % thiocarbamate and 0.3 wt. % oxidation inhibitor whereas Formulation 8 contained no thiocarbamate and 0.8 wt. % oxidation inhibitor. The engine oil formulations and the results of the testing are set forth in Table 2.

Details of the additives used are described below. The base oil was a paraffinic mineral oil having a viscosity index value of 100. The engine oil's viscosity grade was SAE 5W30. Supplemental additives such as anti-foaming agents were added.

Additives:

Metallic detergent—Mixture of overbased calcium phenate, overbased calcium sulfonate and neutral calcium sulfonate.

Ashless dispersant—Boric acid-modified succinimide but different from one in Example 1.

Thiocarbamate—Same as in Example 1.

ZnDTP—Zinc dialkyldithiophosphate of secondary alkyl type (alkyl carbon atom number: 4 to 6).

Oxidation inhibitor—Mixture of dialkyldiphenylamine and molybdenum inhibitor.

VI improver—Dispersant polymethacrylate type.

TABLE 2

| Engine Oil Tested | Formulated Engine Oils No. 7 | No. 8 |
|---|---|---|
| (Formulations) | | |
| Viscosity Grade | SAE 5W30 | |
| Phosphorous (wt. %) | 0.09 | |
| Additives (wt. %) | | |
| Metallic Detergent | 2.7 | 2.7 |
| Ashless Dispersant | 5.4 | 5.4 |
| Thiocarbamate | 0.2 | — |
| ZnDTP | 1.3 | 1.3 |
| Oxidation Inhibitor | 0.3 | 0.8 |
| VI improver | 5.6 | 5.6 |

TABLE 2-continued

| Engine Oil Tested | Formulated Engine Oils No. 7 | No. 8 |
|---|---|---|
| (Test Results) SEQ VE (Pass limit) | | |
| Sludge Average (≧9.0) | 9.4 | 7.1 |
| Rocker Cover (≧7.0) | 9.1 | 6.7 |
| Varnish Average (≧5.0) | 6.2 | 5.8 |
| Piston Skirt (≧6.5) | 7.4 | 7.5 |
| Cam Wear Average (≦5) | 2 | 9 |
| Maximum (≦15) | 7 | 18 |

As can be seen from the results shown in Table 2, at the 0.09 wt. % phosphorous level 0.2 wt. % thiocarbamate was effective, in combination with the zinc dialkyldithiophosphate, to pass the SEQ VE requirements, whereas the identical composition containing the same amount of zinc dialkyldithiophosphate but without the thiocarbamate failed four of the six tests in the SEQ VE and particularly so with respect to cam wear.

Obviously, many modifications and variations of the invention described hereinabove or below can be made without departing from the essence and scope thereof.

What is claimed is:

1. A low phosphorous lubricating oil composition for internal combustion engines, which comprises a major amount of a base oil of lubricating viscosity, an ashless dispersant, a metal-containing detergent, an oxidation inhibitor, and a viscosity index improver, and a wear inhibiting and corrosion inhibiting effective amount of a secondary zinc dialkyldithiophosphate and 0.5–2 wt % of a thiocarbamate antiwear agent selected from the group of compounds having the formula:

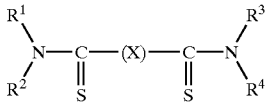

wherein each of $R^1$, $R^2$, $R^3$ and $R^4$ independently represents an alkyl group of 1–6 carbon atoms, and (X) represents S—$CH_2$—S, and wherein the said composition has a phosphorous content of from 0.05 to 0.07 wt % based on the total weight of the lubricating oil composition and wherein phosphorous content is attributable to the phosphorous content of said zinc dialkyldithiophosphate and wherein the weight ratio of said thiocarbamate antiwear agent to said zinc dialkyldithiophosphate wear inhibitor is in the range of about from 1:0.2 to 1:10.

2. The low phosphorous oil composition of claim 1, wherein said thiocarbamate antiwear agent is methylene bis(dibutyldithiocarbamate).

3. A low phosphorous lubricating oil composition of claim 1, wherein said oxidation inhibitor is a hindered phenol, a mixture of hindered phenol and dialkyldiphenylamine, or a mixture of dialkyldiphenylamine and molybdenum inhibitor.

4. A low phosphorous lubricating oil composition of claim 1, wherein said ashless dispersant is boric acid-modified succinimide.

5. A method of reducing wear in a valve train system of an internal combustion engine as measured by reduction in rocker arm scuffing, said method comprising operating said internal combustion engine with a low phosphorous lubricating oil composition comprising a major amount of a base oil of lubricating viscosity, an ashless dispersant, a metal-containing detergent, an oxidation inhibitor, and a viscosity index improver, and a wear inhibiting and corrosion inhibiting effective amount of a secondary zinc dialkyldithiophosphate and 0.5–2 wt % of a thiocarbamate antiwear agent selected from the group of compounds having the formula:

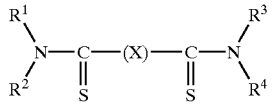

wherein each of $R^3$, $R^2$, $R^3$ and $R^4$ independently represents an alkyl group of 1–6 carbon atoms, and (X) represents S—$CH_2$—S, and wherein the said composition has a phosphorous content of from 0.05 to 0.07 wt % based on the total weight of the lubricating oil composition and wherein phosphorous content is attributable to the phosphorous content of said zinc dialkyldithiophosphate and wherein the weight ratio of said thiocarbamate antiwear agent to said zinc dialkyldithiophosphate wear inhibitor is in the range of about from 1:0.2 to 1:10.

6. The method of claim 5, wherein said thiocarbamate antiwear agent is methylene bis(dibutyldithiocarbamate).

7. The method of claim 5, wherein said oxidation inhibitor is a hindered phenol, a mixture of hindered phenol and dialkyldiphenylamine, or a mixture of dialkyldiphenylamine and molybdenum inhibitor.

8. The method of claim 5, wherein said ashless dispersant is boric acid-modified succinimide.

* * * * *